US009890500B2

(12) United States Patent
Higuchi

(10) Patent No.: US 9,890,500 B2
(45) Date of Patent: Feb. 13, 2018

(54) SHEET MANUFACTURING APPARATUS

(71) Applicant: SEIKO EPSON CORPORATION, Tokyo (JP)

(72) Inventor: Naotaka Higuchi, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 156 days.

(21) Appl. No.: 14/944,506

(22) Filed: Nov. 18, 2015

(65) Prior Publication Data

US 2016/0145802 A1 May 26, 2016

(30) Foreign Application Priority Data

Nov. 26, 2014 (JP) ..... 2014-238484
Jun. 29, 2015 (JP) ..... 2015-129594

(51) Int. Cl.

| | |
|---|---|
| ***D21F 9/04*** | (2006.01) |
| ***D04H 1/732*** | (2012.01) |
| ***D21F 1/52*** | (2006.01) |
| ***D21F 13/00*** | (2006.01) |

(52) U.S. Cl.

CPC ..... *D21F 1/52* (2013.01); *D04H 1/732* (2013.01); *D21F 9/046* (2013.01); *D21F 13/00* (2013.01)

(58) Field of Classification Search

CPC ..... D04H 1/72; D04H 1/732; D04H 1/736; D21F 1/52; D21F 1/60; D21F 9/04; D21F 9/046; D21F 1/526; D21F 1/009; D21F 11/06

USPC ..... 162/318, 357, 212, 213, 214, 217, 292, 162/297, 315, 363, 364; 19/307; 425/80.1, 81.1, 82.1, 83.1

See application file for complete search history.

(56) References Cited

U.S. PATENT DOCUMENTS

| | | | | |
|---|---|---|---|---|
| 4,640,810 | A * | 2/1987 | Laursen | D04H 1/732 264/121 |
| 7,947,203 | B2 * | 5/2011 | Niiranen | D04H 1/72 156/62.2 |
| 2004/0234638 | A1 * | 11/2004 | Thordahl | D04H 1/70 425/83.1 |
| 2014/0027075 | A1 | 1/2014 | Yamagami et al. | |
| 2014/0374047 | A1 | 12/2014 | Yamagami | |

FOREIGN PATENT DOCUMENTS

| | | |
|---|---|---|
| JP | 2012-144819 A | 8/2012 |
| JP | 2015-120998 A | 7/2015 |

* cited by examiner

*Primary Examiner* — Eric Hug
(74) *Attorney, Agent, or Firm* — Workman Nydegger

(57) ABSTRACT

Disclosed is a sheet manufacturing apparatus including a rotatable drum unit in which a plurality of openings are formed; a web forming unit that forms a web by using a material containing fibers passing through the openings; a housing unit that covers at least a portion of the drum unit in which the openings are formed; a material supply port that is provided to supply the material in a direction along a rotational axis of the drum unit to the inside of the drum unit by airflow; and an air intake port that is provided to supply air that does not contain the material in the direction along the rotational axis of the drum unit to the inside of the drum unit. The web forming unit includes a mesh belt on which the material is deposited and a suction unit that sucks the material onto the mesh belt.

11 Claims, 12 Drawing Sheets

SHEET MANUFACTURING APPARATUS

BACKGROUND

1. Technical Field

The present invention relates to a sheet manufacturing apparatus.

2. Related Art

In the related art, as a sheet manufacturing apparatus, a so-called wet type sheet manufacturing apparatus is employed in which a raw material containing fibers is fed into water, is disaggregated mainly by a mechanical action, and is repulped. Such a wet type sheet manufacturing apparatus is large in size since the apparatus requires a large amount of water. Furthermore, it takes time and effort for maintenance of water treatment facilities, and energy for a drying process is increased.

Therefore, for size reduction and energy saving, a dry type sheet manufacturing apparatus in which as little water as possible is used has been proposed. For example, a technique, in which pieces of paper are defibrated into fibers by a dry type defibration machine, deinking of fibers is performed in a cyclone, the deinked fibers pass through a screen having small holes of a forming drum surface, are sucked by a suction device, are deposited on a mesh belt, and then paper is formed, is disclosed in JP-A-2012-144819.

However, in the sheet manufacturing apparatus described above, if fibers are supplied to a forming drum unit by airflow, the amount of fibers deposited on the mesh belt becomes uneven and a grammage of a sheet to be manufactured may become uneven by the airflow being disturbed. Furthermore, the inside of a housing unit accommodating the drum unit has a negative pressure and an intake air amount from a portion between the mesh belt and the housing unit may be increased due to suction of the suction device (suction unit). Thus, the amount of fibers deposited on the mesh belt becomes uneven and the grammage of the sheet to be manufactured may become uneven.

SUMMARY

An advantage of some aspects of the invention is to provide a sheet manufacturing apparatus capable of manufacturing a sheet with high uniformity in grammage.

The invention can be realized in the following aspects or application examples.

According to an aspect of the invention, there is provided a sheet manufacturing apparatus including a rotatable drum unit in which a plurality of openings are formed; a web forming unit that forms a web by using a material containing fibers passing through the openings of the drum unit; a housing unit that covers at least a portion of the drum unit in which the openings are formed; a material supply port that is provided to supply the material containing fibers in a direction along a rotational axis of the drum unit to the inside of the drum unit by airflow; and an air intake port that is provided to supply air, that does not contain the material, in the direction along the rotational axis of the drum unit to the inside of the drum unit. The web forming unit includes a mesh belt on which the material containing fibers is deposited and a suction unit that sucks the material containing fibers onto the mesh belt.

In this case, it is possible to deposit a defibrated material having high uniformity on the mesh belt and it is possible to manufacture a sheet having high uniformity in grammage.

In the sheet manufacturing apparatus, the air intake port may be provided on a periphery of the material supply port.

In this case, it is possible to further reliably suppress that airflow is disturbed on the inside of the drum unit.

The sheet manufacturing apparatus may further include a transport pipe that has an inner surface forming the material supply port, in which a through hole greater than the material supply port in size may be provided in the housing unit, and the air intake port may be a gap formed between a surface of the housing unit forming the through hole and an outer surface of the transport pipe.

In this case, it is possible to further reliably suppress that airflow is disturbed on the inside of the drum unit.

In the sheet manufacturing apparatus, the air intake port may be provided further on the mesh belt side than the material supply port.

In this case, it is possible to further reliably suppress that the web deposited on the mesh belt is disturbed.

In the sheet manufacturing apparatus, the air intake port may be provided in a position nearer to an end portion of the housing unit on a downstream side in a transport direction of the web than the material supply port.

In this case, it is possible to further reliably suppress that the web deposited on the mesh belt is disturbed.

Furthermore, according to another aspect of the invention, there is provided a sheet manufacturing apparatus including a rotatable drum unit in which a plurality of openings are formed; a web forming unit that forms a web by using a material containing fibers passing through the openings of the drum unit; a housing unit that covers at least a portion of the drum unit in which the openings are formed; a material supply port that is provided to supply the material containing fibers to the inside of the drum unit by airflow; and an air intake port that is provided to supply air that does not contain the material from the outside of the housing unit to the inside of the drum unit with the inside of the housing unit having a negative pressure.

In this case, it is possible to suppress that airflow is disturbed on the inside of the drum unit and to form the web while depositing the defibrated material with high uniformity. In addition, it is possible to manufacture a sheet having high uniformity in grammage.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferred embodiments of the invention will be described with reference to the drawings. Moreover, the embodiments described below do not unduly limit the content of the invention described in the aspects. Furthermore, not all configurations described below are essential requirements for the invention.

1. Sheet Manufacturing Apparatus

1.1. Configuration

Figure 1:
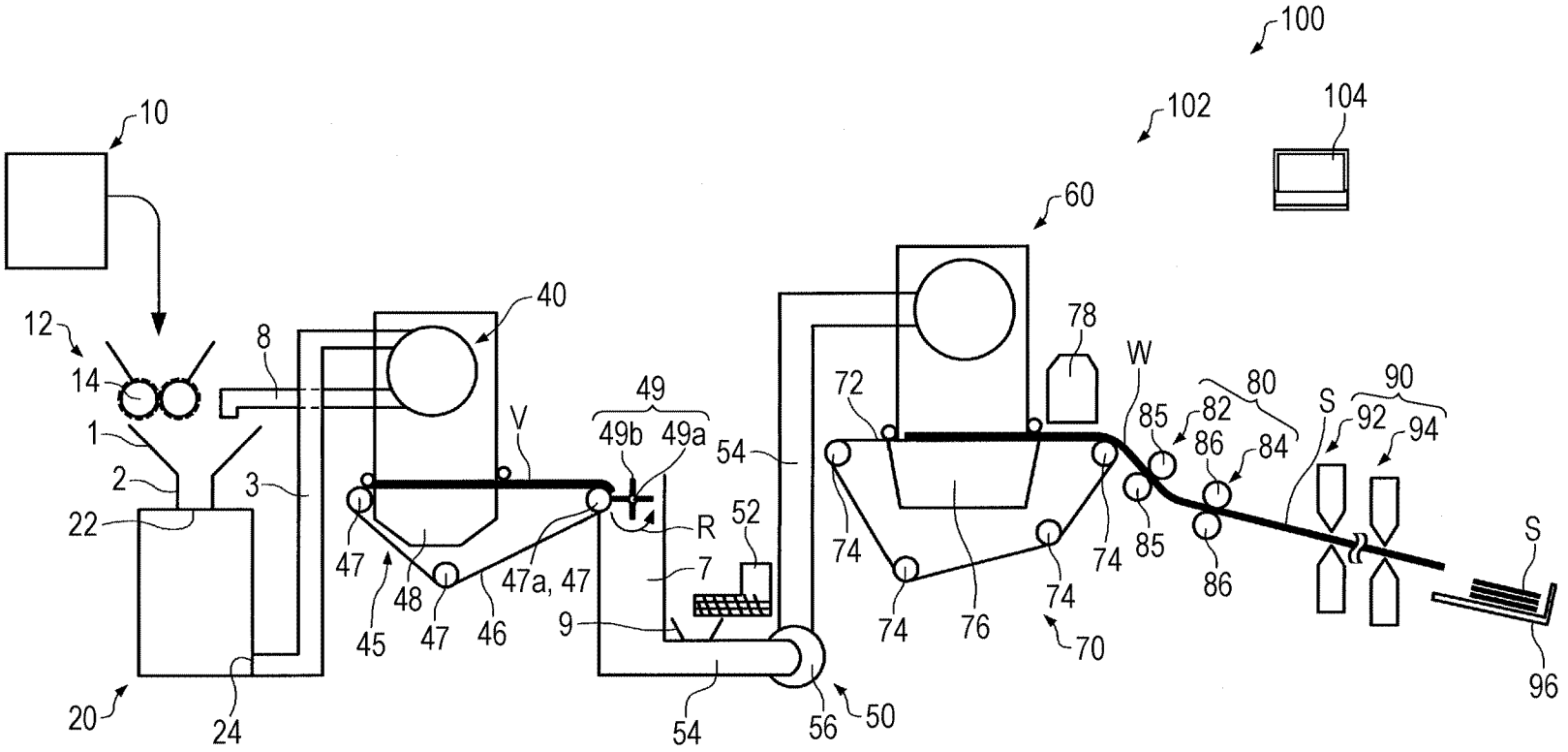
FIG. 1 is a diagram schematically illustrating a sheet manufacturing apparatus according to an embodiment.

First, a sheet manufacturing apparatus according to an embodiment will be described with reference to the drawings. FIG. 1 is a diagram schematically illustrating a sheet manufacturing apparatus 100 of the embodiment.

As illustrated in FIG. 1, the sheet manufacturing apparatus 100 includes a supply unit 10, a manufacturing unit 102, and a control unit 104. The manufacturing unit 102 manufactures a sheet. The manufacturing unit 102 has a crushing unit 12, a defibrating unit 20, a screening unit 40, a first web forming unit 45, a rotary body 49, a mixing unit 50, a deposition unit 60, a second web forming unit 70, a sheet forming unit 80, and a cutting unit 90.

The supply unit 10 supplies a raw material to the crushing unit 12. For example, the supply unit 10 is an automatic feeding unit for continuously feeding the raw material to the crushing unit 12. The raw material supplied by the supply unit 10 contains, for example, used papers and fibers such as pulp sheets.

The crushing unit 12 cuts and shreds the raw material supplied by the supply unit 10 in air. Shapes and sizes of shredded pieces are, for example, squares of several cm. In the illustrated example, the crushing unit 12 has crushing blades 14 and the fed raw material can be cut by the crushing blades 14. For example, as the crushing unit 12, a shredder is used. The raw material that is cut by the crushing unit 12 is received by a hopper 1 and then is transferred (transported) to the defibrating unit 20 through a pipe 2.

The defibrating unit 20 defibrates the raw material that is cut by the crushing unit 12. Here, "defibrating" means that the raw material (defibration object) formed by binding a plurality of fibers is untangled to untangled fibers one by one. The defibrating unit 20 also has a function of separating a material such as resin particles, ink, toner, and a blur-preventing agent, attached to the raw material from the fibers.

A material passing through the defibrating unit 20 is referred to as "defibrated material". In addition to the untangled defibrated material fibers, the "defibrated material" may contain the resin (resin for binding a plurality of fibers to each other) particles, a coloring material such as ink and toner, the blur-preventing agent, and additives such as a paper strengthening agent separated from the fibers when untangling the fibers. A shape of the untangled defibrated material is a string shape or a ribbon shape. The untangled defibrated material may be present in a state of not being intertwined with other untangled fibers (independent state) or may be present in a state of being a lump shape by intertwining with other untangled defibrated materials (a so-called state of forming "lumps").

The defibrating unit 20 performs dry type defibration in the atmosphere (in air). Specifically, as the defibrating unit 20, an impeller mill is used. The defibrating unit 20 has a function of sucking the raw material and generating airflow so as to discharge the defibrated material. Thus, the defibrating unit 20 sucks the raw material from an introduction port 22 together with airflow by the airflow generated by the defibrating unit 20, performs a defibrating process, and then the defibrated material can be transported to a discharge port 24. The defibrated material passing through the defibrating unit 20 is transferred to the screening unit 40 through the pipe 3. Moreover, as the airflow for transporting the defibrated material from the defibrating unit 20 to the screening unit 40, airflow generated by the defibrating unit 20 may be used. In addition, an airflow generation device such as a blower is provided and airflow thereof may be used.

The screening unit 40 introduces the defibrated material that is defibrated by the defibrating unit 20 and screens the defibrated material by lengths of the fibers. As the screening unit 40, for example, a sieve (screen) is used. The screening unit 40 has a net (filter and screen) and can separate the defibrated material into fibers or particles (those passing through the net, first screened matter) smaller than a size of a mesh of the net and fibers, the non-defibrated pieces, or lumps (those that do not pass through the net, second screened matter) which is greater than the mesh of the net in size. For example, the first screened matter is transferred to the mixing unit 50 through a pipe 7. The second screened matter is returned to the defibrating unit 20 through a pipe 8. Specifically, the screening unit 40 is a cylindrical sieve that is driven to be rotated by a motor. As the net of the screening unit 40, for example, wire mesh, expanded metal that is formed by extending a metal plate in which cut lines are run, and a perforated metal in which holes are formed in a metal plate by a press machine are used.

A first web forming unit 45 transports the first screened matter passing through the screening unit 40 to the mixing unit 50. The first web forming unit 45 includes a mesh belt 46, a tension roller 47, and a suction unit (suction mechanism) 48.

The suction unit 48 can suck the first screened matter that is scattered in the air by passing through an opening (opening of the net) of the screening unit 40 on the mesh belt 46. The first screened matter is deposited on the moving mesh belt 46 and forms a web V. Basic configurations of the mesh belt 46, the tension roller 47, and the suction unit 48 are similar to those of a mesh belt 72, a tension roller 74, and a suction unit 76 of the second web forming unit 70 described below.

The web V is formed in a state of being soft and inflated containing a lot of air by going through the screening unit 40 and the first web forming unit 45. The web V deposited in the mesh belt 46 is fed into the pipe 7 and is transported to the mixing unit 50.

The rotary body 49 can cut the web V before the web V is transported to the mixing unit 50. In the illustrated example, the rotary body 49 has a base unit 49*a* and protrusion units 49*b* protruding from the base unit 49*a*. For example, the protrusion units 49*b* have a plate shape. In the illustrated example, four protrusion units 49*b* are provided and the four protrusion units 49*b* are provided at equal intervals. The base unit 49*a* rotates in a direction R and thereby the protrusion units 49*b* can rotate around the base unit 49*a* as an axis. It is possible to reduce variation of the amount of the defibrated material per unit time, for example, supplied to the deposition unit 60 by cutting the web V by the rotary body 49.

The rotary body 49 is provided in the vicinity of the first web forming unit 45. In the illustrated example, the rotary body 49 is provided in the vicinity (next to the tension roller 47*a*) of a tension roller 47*a* positioned on a downstream side in a path of the web V. The rotary body 49 is provided in a position in which the protrusion units 49*b* can come into contact with the web V and do not come into contact with the mesh belt 46 in which the web V is deposited. Thus, it is possible to suppress that the mesh belt 46 is worn (damaged) by the protrusion units 49*b*. The shortest distance between the protrusion unit 49*b* and the mesh belt 46 is, for example, 0.05 mm or more and 0.5 mm or less.

The mixing unit 50 mixes the first screened matter (the first screened matter transported by the first web forming unit 45) passing through the screening unit 40 and additives containing resin. The mixing unit 50 has an additive supply unit 52, a pipe 54 that transports the first screened matter and the additives, and a blower 56. In the illustrated example, the additives are supplied from the additive supply unit 52 to the pipe 54 through a hopper 9. The pipe 54 is connected to the pipe 7.

In the mixing unit 50, airflow is generated by the blower 56 and in the pipe 54, it is possible to transport the first screened matter and the additives while being mixed. Moreover, a mechanism for mixing the first screened matter and the additives is not specifically limited, may be one which stirs the first screened matter and the additives by blades rotating at a high speed or may be one which uses rotation of a container as a V type mixer.

As the additive supply unit 52, a screw feeder as illustrated in FIG. 1, a disk feeder (not illustrated), and the like are used. The additives supplied from the additive supply unit 52 contain resin for binding a plurality of fibers. At the time resin is supplied, the plurality of fibers are not bound. Resin is melted when passing through the sheet forming unit 80 and binds the plurality of fibers.

Resin supplied from the additive supply unit 52 is thermoplastic resin or thermosetting resin, and for example, is AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, polyether ether ketone, and the like. These resins may be used singly or by being appropriately mixed. The additives supplied from the additive supply unit 52 may be fiber or powder.

Moreover, the additives supplied from the additive supply unit 52 may contain coloring agents for coloring fibers, a coagulation preventing agent for preventing coagulation of fibers, and a flame retardant for deflocculating material for fibers are unlikely to burn depending on a type of the manufacturing sheet in addition to resin binding fibers. A mixture (mixture of the first screened matter and the additives) passing through the mixing unit 50 is transferred to the deposition unit 60 through the pipe 54.

The deposition unit 60 allows the mixture passing through the mixing unit 50 to be introduced, and entangled defibrated material (fibers) to be loosened, and to be dropped while dispersing in the air. Furthermore, the deposition unit 60 allows entangled resins to be loosened if resins of the additives supplied from the additive supply unit 52 are fibers. Thus, the deposition unit 60 can deposit the mixture in the second web forming unit 70 with high uniformity.

As the deposition unit 60, a rotating cylindrical sieve is used. The deposition unit 60 has a net and allows fibers or particles (passing through the net) contained in the mixture passing through the mixing unit 50, which are smaller than the size of a mesh of the net, to be dropped. A configuration of the deposition unit 60 is, for example, the same as the configuration of the screening unit 40.

Moreover, the "sieve" of the deposition unit 60 may not have a function of selecting a particular object. That is, the "sieve" that is used for the deposition unit 60 means a sieve having a net and the deposition unit 60 may allow all mixtures introduced into the deposition unit 60 to be dropped.

The second web forming unit 70 forms the web W by depositing a passing object passing through the deposition unit 60. The second web forming unit 70 has, for example, the mesh belt 72, the tension roller 74, and the suction unit 76.

The mesh belt 72 deposits the passing object passing through an opening (opening of the net) of the deposition unit 60 while moving. The mesh belt 72 is stretched by the tension roller 74 and has a configuration through which the passing object is unlikely to pass and air is likely to pass. The mesh belt 72 is moved by rotation of the tension roller 74. The passing object passing through the deposition unit 60 is continuously dropped and deposited while the mesh belt 72 continuously moves and thereby the web W is formed on the mesh belt 72. The mesh belt 72 is, for example, metal, resin, fabric, nonwoven fabric, and the like.

The suction unit 76 is provided on a lower side (side opposite to the deposition unit 60 side) of the mesh belt 72. The suction unit 76 can generate airflow (airflow from the deposition unit 60 to the mesh belt 72) to the lower side. The mixture dispersed in the air by the deposition unit 60 can be sucked on the mesh belt 72 by the suction unit 76. Thus, it is possible to increase a discharge speed from the deposition unit 60. Furthermore, it is possible to form down flow in a fall path of the mixture by the suction unit 76 and it is possible to prevent falling defibrated material and a mixture from being entangled.

As described above, a web W in a state of being soft and inflated containing a lot of air is formed by going through the deposition unit 60 and the second web forming unit 70 (web forming process). The web W deposited in the mesh belt 72 is transported to the sheet forming unit 80.

Moreover, in the illustrated example, a moisture-adjusting unit 78 adjusting moisture of the web W is provided. The moisture-adjusting unit 78 can adjust an amount ratio of the web W and water by adding water or steam with respect to the web W.

The sheet forming unit 80 forms a sheet S by pressurizing and heating the web W deposited in the mesh belt 72. In the sheet forming unit 80, it is possible to bind the plurality of fibers in the mixture through the additives (resin) to each other by adding heat to the mixture of the defibrated material and the additives mixed in the web W.

The sheet forming unit 80 includes a pressurizing unit 82 that pressurizes the web W and a heating unit 84 that heats the web W pressurized by the pressurizing unit 82. The pressurizing unit 82 is configured of a pair of calendar rollers 85 and applies pressure to the web W. A thickness of the web W is reduced and a density of the web W is increased by applying the pressure. As the heating unit 84, for example, a heating roller (heater roller), a heat press molding machine, a hot plate, a hot air blower, an infrared heater, and a flash fixer are used. In the illustrated example, the heating unit 84 is configured of a pair of heating rollers 86. The heating unit 84 is configured of the heating rollers 86 and thereby it is possible to form the sheet S while continuously transporting the web W compared to a case where the heating unit 84 is configured as a plate-shaped press device (flat plate press device). Here, the calendar rollers 85 (pressurizing unit 82) can apply a pressure higher than a pressure applied to the web W by the heating rollers 86 (heating unit 84) to the web W. Moreover, the number of the calendar rollers 85 and the heating rollers 86 is not specifically limited.

The cutting unit 90 cuts the sheet S formed by the sheet forming unit 80. In the illustrated example, the cutting unit 90 has a first cutting unit 92 that cuts the sheet S in a direction orthogonal to the transport direction of the sheet S and a second cutting unit 94 that cuts the sheet S in a direction parallel to the transport direction. For example, the second cutting unit 94 cuts the sheet S passing through the first cutting unit 92.

As described above, a cut sheet S of a predetermined size is formed. The cut sheet S that is cut is discharged to a discharge unit 96.

1.2. Housing Unit, Material Supply Port, and Air Intake Port

Figure 2:
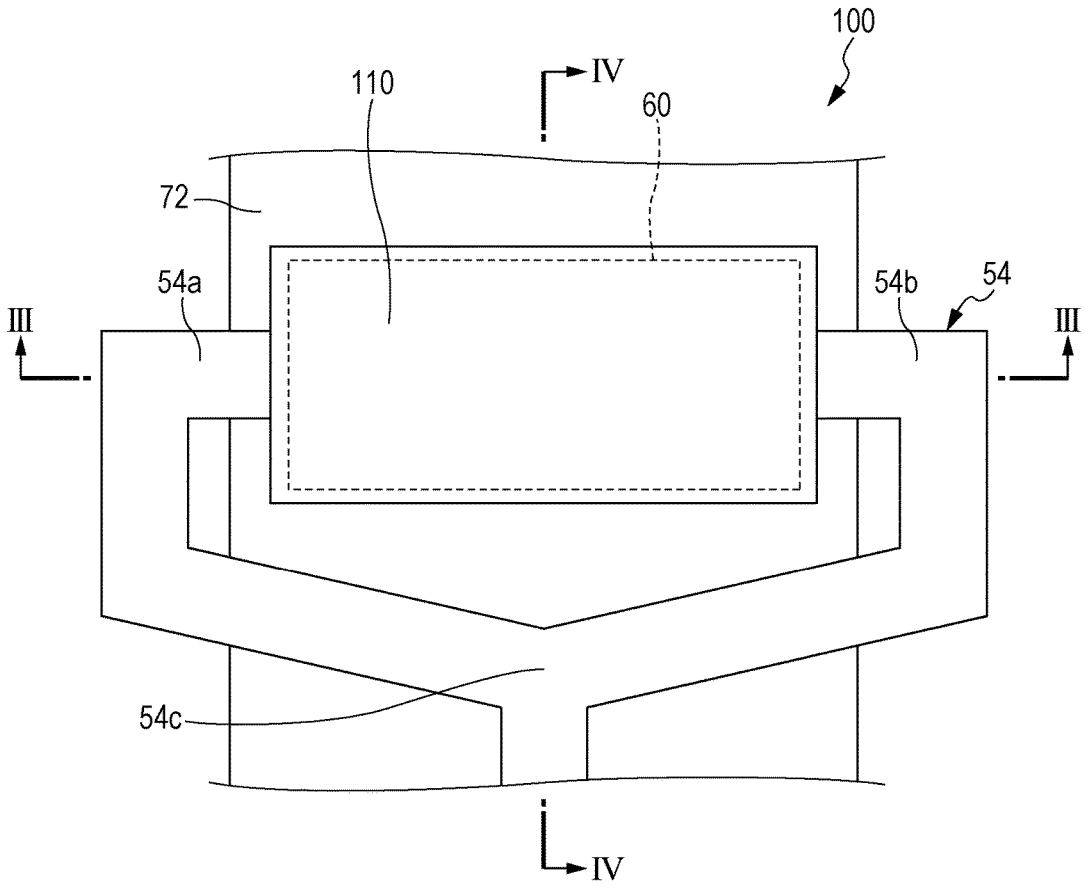
FIG. 2 is a plan view schematically illustrating the sheet manufacturing apparatus according to the embodiment.
Figure 3:
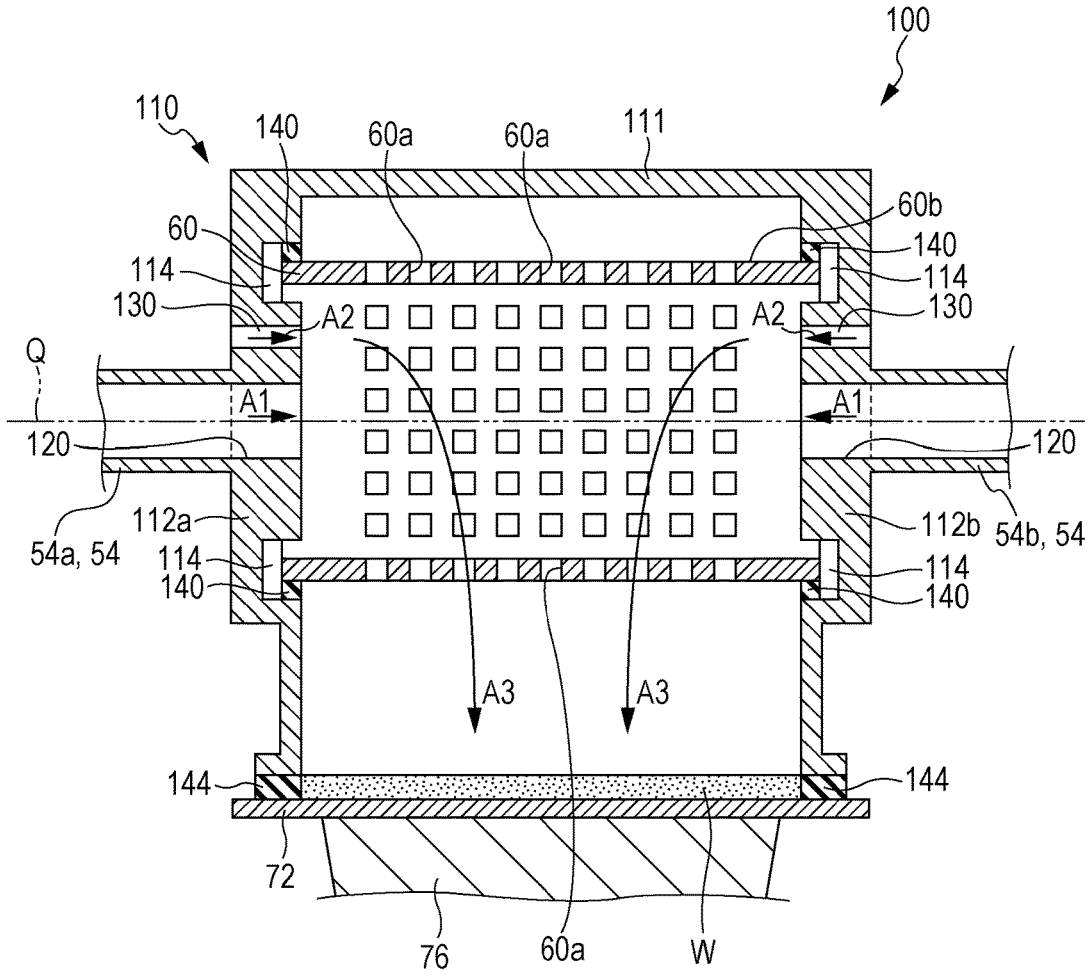
FIG. 3 is a sectional view schematically illustrating the sheet manufacturing apparatus according to the embodiment.
Figure 4:
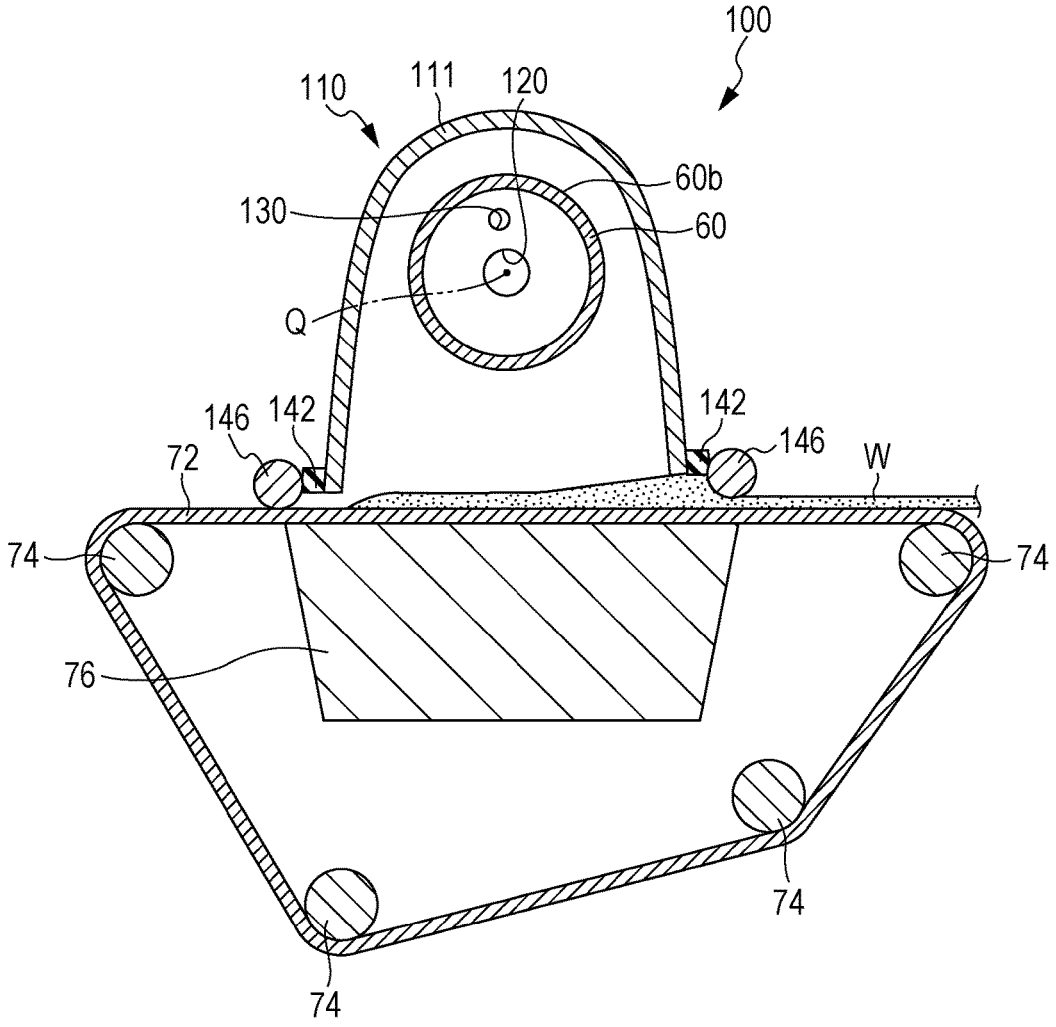
FIG. 4 is a sectional view schematically illustrating the sheet manufacturing apparatus according to the embodiment.
Figure 5:
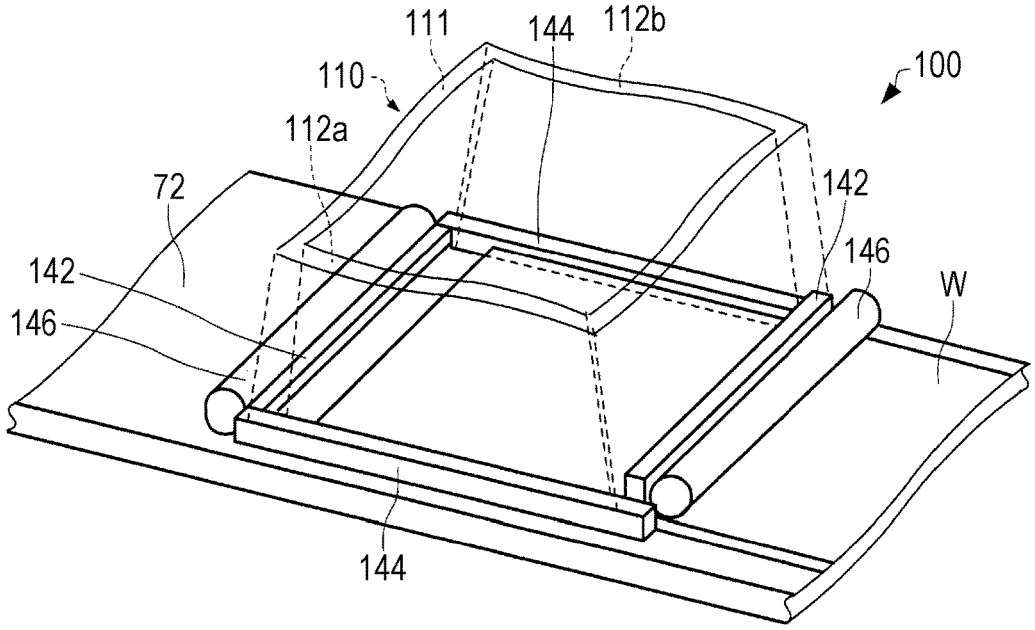
FIG. 5 is a perspective view schematically illustrating the sheet manufacturing apparatus according to the embodiment.

The sheet manufacturing apparatus 100 further has a housing unit 110, a material supply port 120, and an air intake port 130. Hereinafter, the housing unit 110, the material supply port 120, and the air intake port 130 will be described in detail. FIG. 2 is a plan view schematically illustrating the vicinity of the housing unit 110. FIG. 3 is a sectional view that is taken along line III-III of FIG. 2 schematically illustrating the vicinity of the housing unit 110. FIG. 4 is a sectional view that is taken along line IV-IV of FIG. 2 schematically illustrating the vicinity of the housing unit 110. FIG. 5 is a perspective view schematically illustrating the vicinity of the housing unit 110.

The deposition unit 60 is a cylindrical drum (hereinafter, the deposition unit is also referred to as a drum unit) formed to be rotatable around a rotational axis Q. A plurality of openings 60*a* are formed in a peripheral surface of the drum unit (deposition unit) 60. The deposition unit 60 allows fibers (defibrated material) passing through the openings 60*a* to be deposited on the mesh belt 72. That is, the defibrated material is deposited in the mesh belt 72. The second web forming unit 70 forms the web W by using the defibrated material passing through the openings 60*a* of the drum unit 60. A size, a shape, and the number of the openings 60*a* are not specifically limited. Moreover, for the sake of convenience, the openings 60*a* are largely illustrated with respect to the drum unit 60 in FIGS. 3, 10, 12, and 13.

The housing unit 110 covers a portion (outer peripheral surface 60*b* on which the openings 60*a* are formed) in which at least the openings 60*a* of the drum unit 60 are formed through gaps. In the example illustrated in FIGS. 3 and 4, the housing unit 110 has an opposite wall unit 111 having an inner surface opposite to the outer peripheral surface 60*b*, a first side wall unit 112*a*, and a second side wall unit 112*b* which are connected to the opposite wall unit 111 and cover the drum unit 60 in a direction of the rotational axis Q (direction in which the rotational axis Q extends), and accommodates the drum unit 60.

As illustrated in FIG. 3, concave units 114 are provided on inner surfaces of the side wall units 112*a* and 112*b* of the housing unit 110. Pile seals 140 are provided in the concave units 114. The drum unit 60 is supplied to be rotatable with a predetermined interval with the housing unit 110 through the pile seals 140. The pile seal 140 is, for example, configured of a brush where densely thin hairs are planted on a surface of a base unit.

The pipe (transport pipe) 54 is connected to the side wall units 112*a* and 112*b* of the housing unit 110. The transport pipe 54 transports (supplies) the defibrated material to the inside of the drum unit 60. As illustrated in FIG. 2, the transport pipe 54 is branched into a first portion 54*a* and a second portion 54*b* in a branch unit 54*c*, the first portion 54*a* is connected to the first side wall unit 112*a*, and the second portion 54*b* is connected to the second side wall unit 112*b*. Thus, it is possible to supply the defibrated material from both sides of the drum unit 60 to the inside of the drum unit 60. In the illustrated example, the transport pipe 54 is integrally provided with the housing unit 110. Moreover, connection between the deposition unit 60 and the transport pipe 54, and connection between the screening unit 40 and the pipes 3 and 8 are simplified in FIG. 1.

The material supply ports 120, which supply the defibrated material in the direction of the rotational axis Q to the inside of the drum unit 60 by airflow A1, are provided in the side wall units 112*a* and 112*b* of the housing unit 110. The material supply port 120 is a through hole extending in the direction of the rotational axis Q. A direction of the airflow A1 within the material supply port 120 is the direction of the rotational axis Q. In the illustrated example, one material supply port 120 is provided in each of the side wall units 112*a* and 112*b* of the housing unit 110. As illustrated in FIG. 4, the material supply port 120 is provided in a position overlapping the rotational axis Q when viewed in the direction of the rotational axis Q. The material supply port 120 provided in the first side wall unit 112*a* communicates with the inside of the first portion 54*a* of the transport pipe 54. The material supply port 120 provided in the second side wall unit 112*b* communicates with the inside of the second portion 54*b* of the transport pipe 54.

The air intake ports 130, which supply air (for example, air on the outside of the housing unit 110) that does not contain the defibrated material (material) in the direction of the rotational axis Q of the drum unit 60 to the inside of the drum unit 60 by airflow A2, are provided in the housing unit 110. The air intake port 130 is a through hole extending in the direction of the rotational axis Q. For example, a direction of the airflow A2 generated within the air intake port 130 is the direction of the rotational axis Q. In the illustrated example, one air intake port 130 is provided in each of the side wall units 112*a* and 112*b* of the housing unit 110. The air intake port 130 is provided at a distance from the material supply port 120. As illustrated in FIG. 4, the air intake port 130 is provided in a position overlapping the inside of the drum unit 60 when viewed in the direction of the rotational axis Q. For example, the air intake port 130 communicates with the outside of the housing unit 110 and the inside of the drum unit 60.

For example, the air intake port 130 is provided on a side opposite (position far from the mesh belt 72) to the mesh belt 72 side further than the material supply port 120. That is, a distance between the air intake port 130 and the mesh belt 72 is greater than a distance between the material supply port 120 and the mesh belt 72.

Moreover, the airflow A1 is generated by the blower 56. The airflow A2 is generated by natural air intake by a difference between a first flow rate (in the illustrated example, a total flow rate from two material supply ports 120) supplied (pushed) from the material supply ports 120 to the inside of the housing unit 110 by the blower 56 and a second flow rate discharged to the outside of the housing unit 110 by the suction unit 76. That is, air on the inside of the housing unit 110 is discharged, the inside of the housing unit 110 is a negative pressure, and thereby air on the outside of the housing unit 110 is supplied from the air intake port 130 to the inside of the drum unit 60 (housing unit 110). The suction device (suction unit) 76 generates airflow vertically downward and sucks the defibrated material on the mesh belt 72.

For example, if the first flow rate is 0.8 $m^3$/min and the second flow rate is 1.5 $m^3$/min, a third flow rate (in the illustrated example, a total flow rate from two air intake ports 130) supplied from the air intake port 130 to the inside of the housing unit 110 is 0.7 $m^3$/min. If the first flow rate is 0.8 $m^3$/min and the second flow rate is 3 $m^3$/min, the third flow rate is 2.2 $m^3$/min. As described above, in the sheet manufacturing apparatus 100, it is possible to suppress that the first flow rate is changed depending on a change in the second flow rate by providing the air intake port 130. That is, it is possible to independently change the first flow rate and the second flow rate. For example, in a case where the air intake port is not provided, if the second flow rate is changed, the first flow rate is also changed.

For example, the third flow rate is 20% or more of the second flow rate and is preferably 50% or more of the second flow rate. Moreover, the second flow rate is greater than the first flow rate in size and thereby it is possible to suppress that air on the inside of the housing unit 110 is leaked from the material supply port 120 to the outside.

The housing unit 110 is provided with a predetermined interval with the mesh belt 72 through pile seals 142 and 144. In the example illustrated in FIG. 5, the pile seals 142 and 144 have rectangular parallelepiped (substantially rectangular parallelepiped) shapes. The pile seals 142 and 144 are, for example, configured of a brush where densely thin hairs are planted on a surface of a base unit. The opposite wall unit 111 of the housing unit 110 is connected to seal rollers 146 through the pile seals 142. For example, the seal roller 146 is a metal roller, is biased by its own weight thereof and a biasing member such as a spring, and comes into contact with the mesh belt 72 in a state where the web W is not deposited on the mesh belt 72. The side wall units 112*a* and 112*b* of the housing unit 110 are provided with a predetermined interval with the mesh belt 72 through the pile seals 144. The pile seals 142 and 144, and the seal roller 146 can suppress that the defibrated material is leaked from the interval between the housing unit 110 and the mesh belt 72.

Moreover, for example, if the web W deposited in the mesh belt 72 has a distribution of a thickness in the width direction (direction of the rotational axis Q) of the mesh belt 72, or a size of the web W in the width direction (direction of the rotational axis Q) is smaller than a size of the pile seals 142 or the seal roller 146 in the width direction (direction of the rotational axis Q), an interval through which air passes from the outside to the inside of the housing unit 110 may be generated.

For example, the sheet manufacturing apparatus 100 has the following characteristics.

The sheet manufacturing apparatus 100 has the material supply port 120 that is provided to supply the defibrated material in the direction of the rotational axis Q to the inside of the drum unit 60 by the airflow A1 and the air intake port 130 that is provided to supply air that does not contain the material in the direction of the rotational axis Q of the drum unit 60 to the inside of the drum unit 60 by the airflow A2. Thus, in the sheet manufacturing apparatus 100, it is possible to suppress (it is possible to rectify) that airflow is disturbed on the inside of the drum unit 60 and to deposit the defibrated material on the mesh belt 72 with high uniformity. Furthermore, for example, the sheet manufacturing apparatus 100 can suppress that airflow is disturbed on the inside of the housing unit 110.

For example, if the air intake port is not provided, the airflow entering the inside of the drum unit from the material supply port collides with the inner surface of the housing unit and then spiral airflow is generated and the airflow may be disturbed on the inside of the drum unit. On the other hand, in the sheet manufacturing apparatus 100, it is possible to generate airflow A3 flowing from the air intake port 130 to the suction unit 76 by providing the air intake port 130. Thus, it is possible to suppress (it is possible to weaken the airflow colliding with the inside of the housing unit) that the airflow A1 collides with the inside of the housing unit by allowing the airflow A1 within the material supply port 120 to enter the inside of the drum unit 60 and to suppress that the airflow on the inside of the drum unit 60 is disturbed.

Furthermore, in the sheet manufacturing apparatus 100, it is possible to reduce the intake air amount of air sucked from the interval (as described above, interval generated by the web W having the distribution of the thickness in the width direction of the mesh belt 72) through which air passes from the outside to the inside of the housing unit 110 to the inside of the housing unit by providing the air intake port 130. Thus, in the sheet manufacturing apparatus 100, it is possible to suppress that the web W is disturbed (for example, the web W is turned up) and to deposit the defibrated material on the mesh belt 72 with high uniformity by sucking air from the interval.

Thus, in the sheet manufacturing apparatus 100, it is possible to manufacture the sheet S having high uniformity of the grammage.

Figure 6:
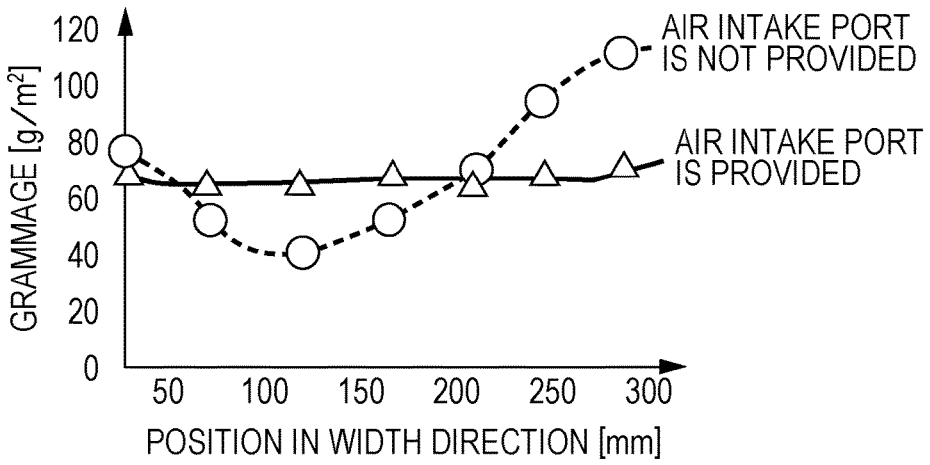
FIG. 6 is a graph illustrating a grammage of a sheet with respect to a position of the sheet in a width direction thereof.

Here, FIG. 6 is a graph illustrating the grammage with respect to the position of the sheet in the width direction (direction of the rotational axis Q) thereof. It can be seen from FIG. 6 that if the air intake port is provided, uniformity of the grammage in the width direction is increased compared to a case where the air intake port is not provided. Moreover, FIG. 6 illustrates results of measurements of the grammages of the sheets in the sheet manufacturing apparatus 100 (sheet manufacturing apparatus having the air intake port) as illustrated in FIGS. 1 to 5 and a sheet manufacturing apparatus (sheet manufacturing apparatus having no air intake port) having the same configuration as the sheet manufacturing apparatus 100 except that the air intake port 130 is not provided.

Furthermore, in the sheet manufacturing apparatus 100, as described above, it is possible to suppress that the first flow rate is changed depending on the change in the second flow rate by providing the air intake port 130. For example, in a case where the air intake port 130 is not provided, if the second flow rate is increased, the first flow rate is also increased, a mixing degree of the first screened matter (the defibrated material) passing through the screening unit 40 and the additives containing resin is lowered (the defibrated material and the additives are not easily mixed), and then the uniformity of strength of the sheet may be lowered. In the sheet manufacturing apparatus 100, it is possible to avoid such a problem and to manufacture the sheet S having high uniformity of the strength.

In the sheet manufacturing apparatus 100, the air intake port 130 is provided on the side opposite to the mesh belt 72 side further than the material supply port 120. Thus, in the sheet manufacturing apparatus 100, it is possible to further reliably suppress that the airflow entering the inside of the drum unit 60 from the material supply port 120 collides with the inner surface of the housing unit 110 compared to a case where the air intake port 130 is provided on the mesh belt 72 side further than the material supply port 120.

Moreover, in the sheet manufacturing apparatus according to the invention, similar to the deposition unit 60, the screening unit 40 is configured of the rotatable drum unit in which the plurality of openings are formed and the housing unit 110 covering the portion, in which at least openings of the screening unit 40 are formed, is provided. The screening unit 40 may have the material supply port 120 that is provided to supply the defibrated material to the inside of the screening unit 40 and the air intake port 130 that is provided to supply air that does not contain the defibrated material to the inside of the screening unit 40.

Furthermore, in the sheet manufacturing apparatus according to the invention, the defibrated material passing through the defibrating unit 20 may be transported to a classifying unit (not illustrated) through the pipe 3. Then, a classified material that is classified in the classifying unit may be transported to the screening unit 40. The classifying unit classifies the defibrated material passing through the defibrating unit 20. Specifically, the classifying unit screens and removes relatively small defibrated material and the defibrated material (resin particles, coloring materials, additives, and the like) having low density in the defibrated materials. Thus, it is possible to increase a ratio of fibers that are relatively large and have high density in the defibrated materials. As the classifying unit, for example, cyclone, elbow jet, eddy classifier, and the like are used.

2. Modification Example of Sheet Manufacturing Apparatus

2.1. First Modification Example

Figure 7:
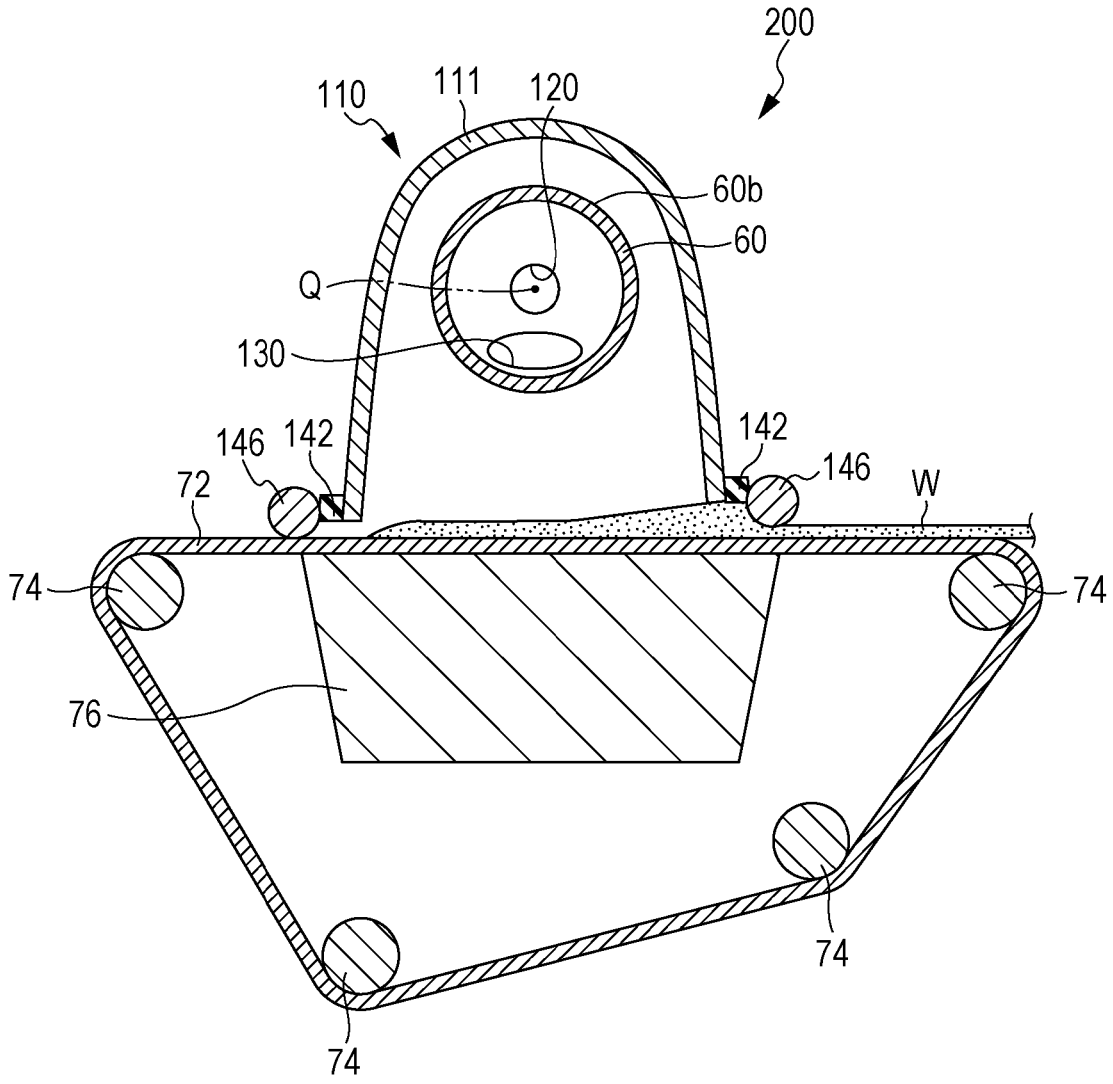
FIG. 7 is a sectional view schematically illustrating a sheet manufacturing apparatus according to a first modification example of the embodiment.

Next, a sheet manufacturing apparatus according to a first modification example of the embodiment will be described with reference to the drawing. FIG. 7 is a sectional view schematically illustrating a sheet manufacturing apparatus 200 according to the first modification example of the embodiment and illustrates the same cross section as that of FIG. 4.

Hereinafter, in the sheet manufacturing apparatus 200 according to the first modification example of the embodiment, configurations different from the example of the sheet manufacturing apparatus 100 according to the embodiment will be described and description of the same configurations will be omitted. This is equally applied to sheet manufacturing apparatuses according to second to sixth modification examples illustrated below.

In the sheet manufacturing apparatus 100 described above, as illustrated in FIG. 4, the air intake port 130 is provided on the side opposite to the mesh belt 72 side further than the material supply port 120.

On the other hand, in the sheet manufacturing apparatus 200, as illustrated in FIG. 7, an air intake port 130 is provided on a mesh belt 72 side (position close to the mesh belt 72) further than a material supply port 120. That is, a distance between the air intake port 130 and the mesh belt 72 is smaller than a distance the material supply port 120 and the mesh belt 72. As illustrated in FIG. 7, the air intake port 130 is positioned between the material supply port 120 and the mesh belt 72 when viewed in a direction of a rotational axis Q. In the illustrated example, a shape of the air intake port 130 is elliptical, but is not specifically limited, and may be, for example, circular.

In the sheet manufacturing apparatus 200, the air intake port 130 is provided on the mesh belt 72 side further than the material supply port 120. Thus, in the sheet manufacturing apparatus 200, it is possible to reduce an intake air amount (intake air amount to an inside of a housing unit 110) from a portion between a pile seal 144 (for example, see FIG. 5) and the mesh belt 72, for example, compared to a case where the air intake port 130 is provided on a side opposite to the mesh belt 72 side further than the material supply port 120. Thus, in the sheet manufacturing apparatus 200, it is possible to further reliably suppress that a web W is disturbed. Furthermore, in the sheet manufacturing apparatus 200, it is possible to achieve low density of the pile seal 144 and to reduce a width of the pile seal 144. In addition, it is possible to achieve sliding load reduction and low torque driving of the mesh belt 72.

2.2. Second Modification Example

Figure 8:
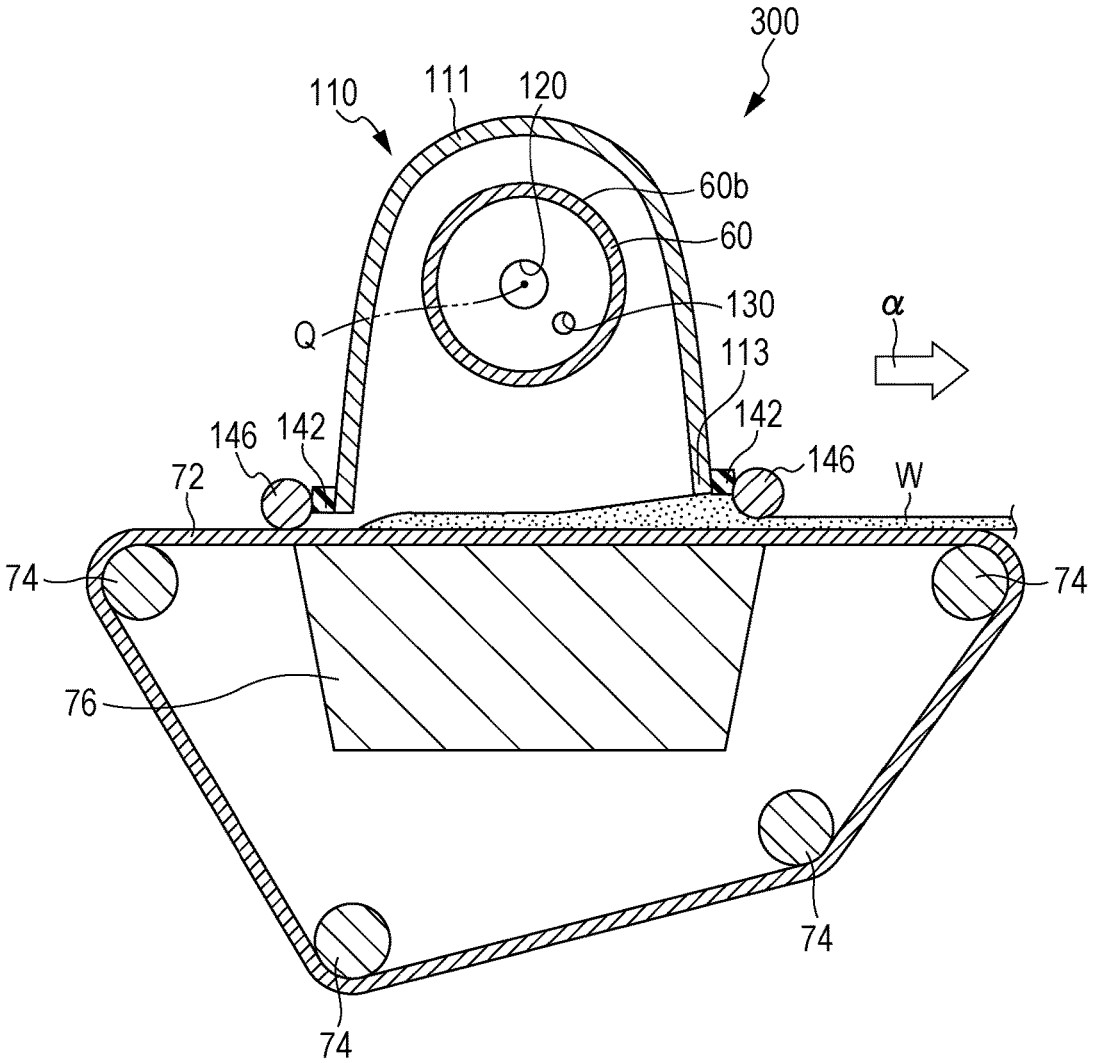
FIG. 8 is a sectional view schematically illustrating a sheet manufacturing apparatus according to a second modification example of the embodiment.

Next, a sheet manufacturing apparatus according to a second modification example of the embodiment will be described with reference to the drawing. FIG. 8 is a sectional view schematically illustrating a sheet manufacturing apparatus 300 according to the second modification example of the embodiment and illustrates the same cross section as FIG. 4.

In the sheet manufacturing apparatus 100 described above, as illustrated in FIG. 4, the air intake port 130 is provided on the side opposite to the mesh belt 72 side further than the material supply port 120.

On the other hand, in the sheet manufacturing apparatus 300, similar to the sheet manufacturing apparatus 200 described above, an air intake port 130 is provided on a mesh belt 72 side further than a material supply port 120. Furthermore, as illustrated in FIG. 8, in the sheet manufacturing apparatus 300, the air intake port 130 is provided in a position closer to an end portion 113 of a housing unit 110 on a downstream side in a transport direction of a web W further than the material supply port 120. That is, a distance between the air intake port 130 and the end portion 113 is smaller than a distance between the material supply port 120 and the end portion 113. As illustrated in FIG. 8, the air intake port 130 is, for example, positioned between the material supply port 120 and the end portion 113 when viewed in a direction of a rotational axis Q.

The end portion 113 of the housing unit 110 is an end portion on a side in a direction a in which the web W is transported. When the web W is transported from the inside to the outside of the housing unit 110, the end portion 113 forms an outlet of the web W. The end portion 113 comes into contact with a pile seals 142.

In the sheet manufacturing apparatus 300, the air intake port 130 is provided on the mesh belt 72 side further than the material supply port 120 and is provided in the position closer to the end portion 113 of the housing unit 110 on the downstream side in the transport direction of the web W further than the material supply port 120. Thus, in the sheet manufacturing apparatus 300, for example, it is possible to reduce an intake air amount (the intake air amount to the inside of the housing unit 110) from an interval below the end portion 113 compared to a case where the air intake port 130 is provided in a position farther to the end portion 113 than the material supply port 120, when the web W is transported from the inside to the outside of the housing unit 110. Thus, in the sheet manufacturing apparatus 300, it is possible to further reliably suppress that the web W is disturbed.

2.3. Third Modification Example

Figure 9:
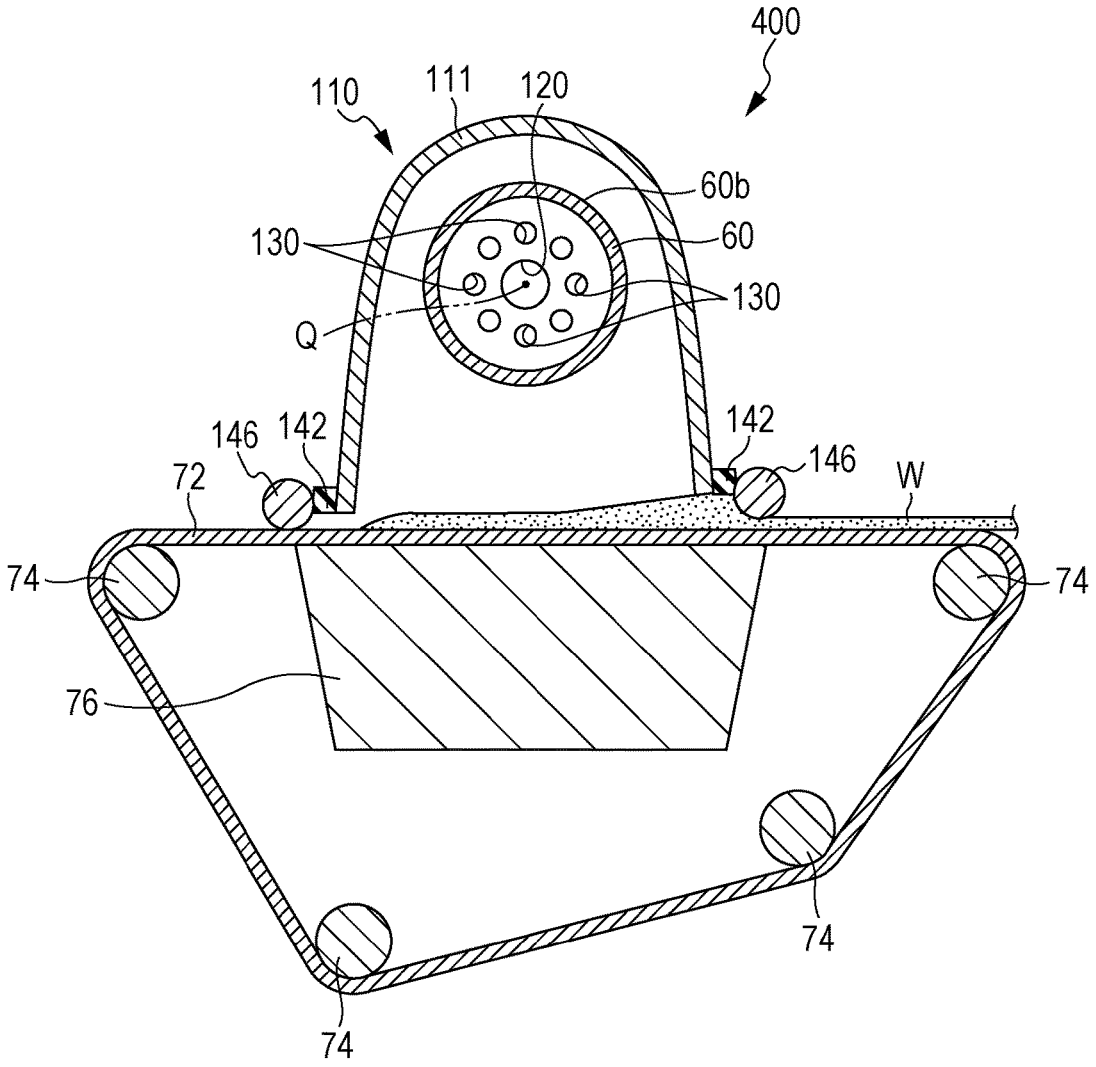
FIG. 9 is a sectional view schematically illustrating a sheet manufacturing apparatus according to a third modification example of the embodiment.

Next, a sheet manufacturing apparatus according to a third modification example of the embodiment will be described with reference to the drawing. FIG. 9 is a sectional view schematically illustrating a sheet manufacturing apparatus 400 according to the third modification example of the embodiment and illustrates the same cross section as FIG. 4.

In the sheet manufacturing apparatus 100 described above, as illustrated in FIGS. 3 and 4, one air intake port 130 is provided in each of the side wall units 112*a* and 112*b* of the housing unit 110.

On the other hand, in the sheet manufacturing apparatus 400, as illustrated in FIG. 9, a plurality of air intake ports 130 are provided in each of side wall units 112*a* and 112*b* of a housing unit 110 and the plurality of air intake ports 130 are provided in a periphery of a material supply port 120 when viewed in the direction of the rotational axis Q. In the illustrated example, the plurality of air intake ports 130 are provided in the periphery of the material supply port 120 at equal intervals and are provided so as to surround the material supply port 120. Moreover, the number of the air intake ports 130 is not specifically limited.

In the sheet manufacturing apparatus 400, the plurality of air intake ports 130 are provided in the periphery of the material supply port 120. Thus, in the sheet manufacturing apparatus 400, for example, it is possible to further reliably suppress that airflow on an inside of a drum unit 60 is disturbed compared to a case where one air intake port 130 is provided in each of the side wall units 112*a* and 112*b*.

2.4. Fourth Modification Example

Figure 10:
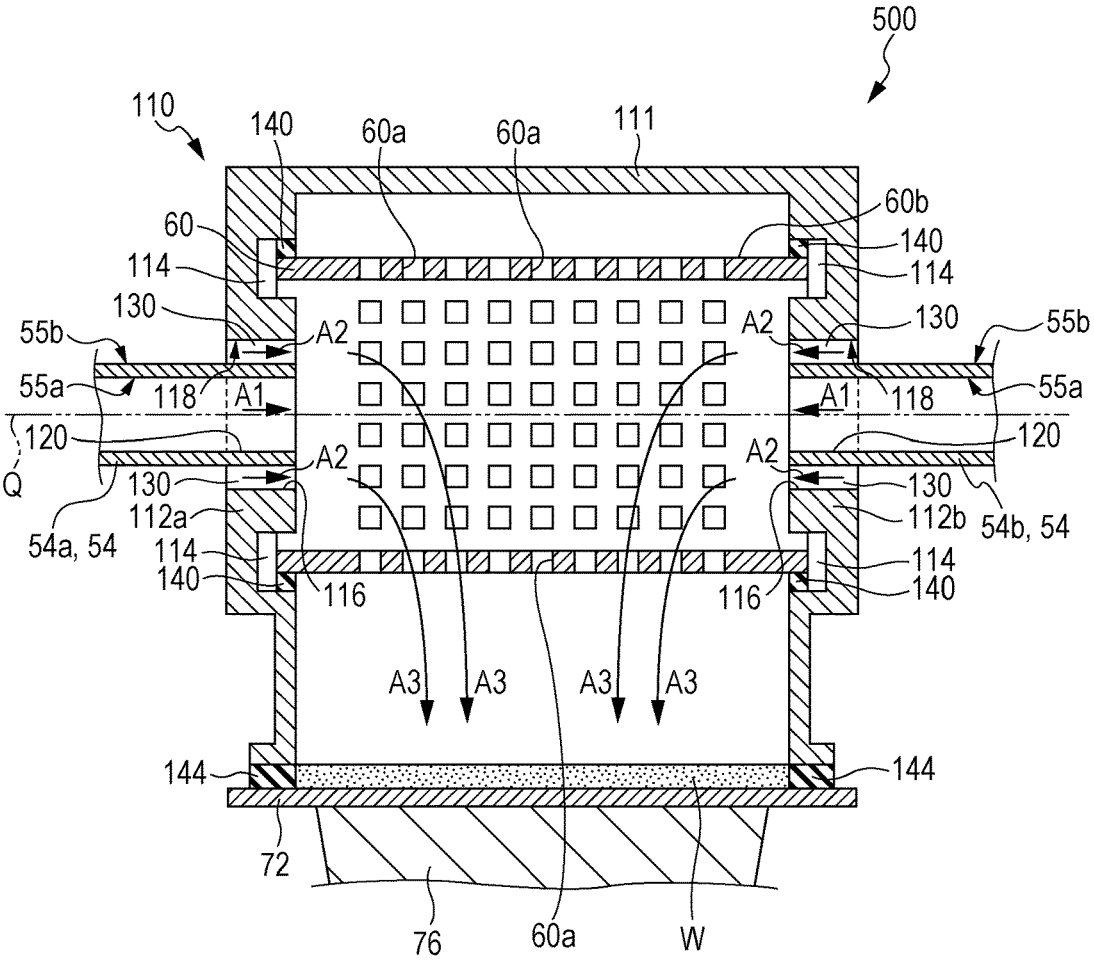
FIG. 10 is a sectional view schematically illustrating a sheet manufacturing apparatus according to a fourth modification example of the embodiment.
Figure 11:
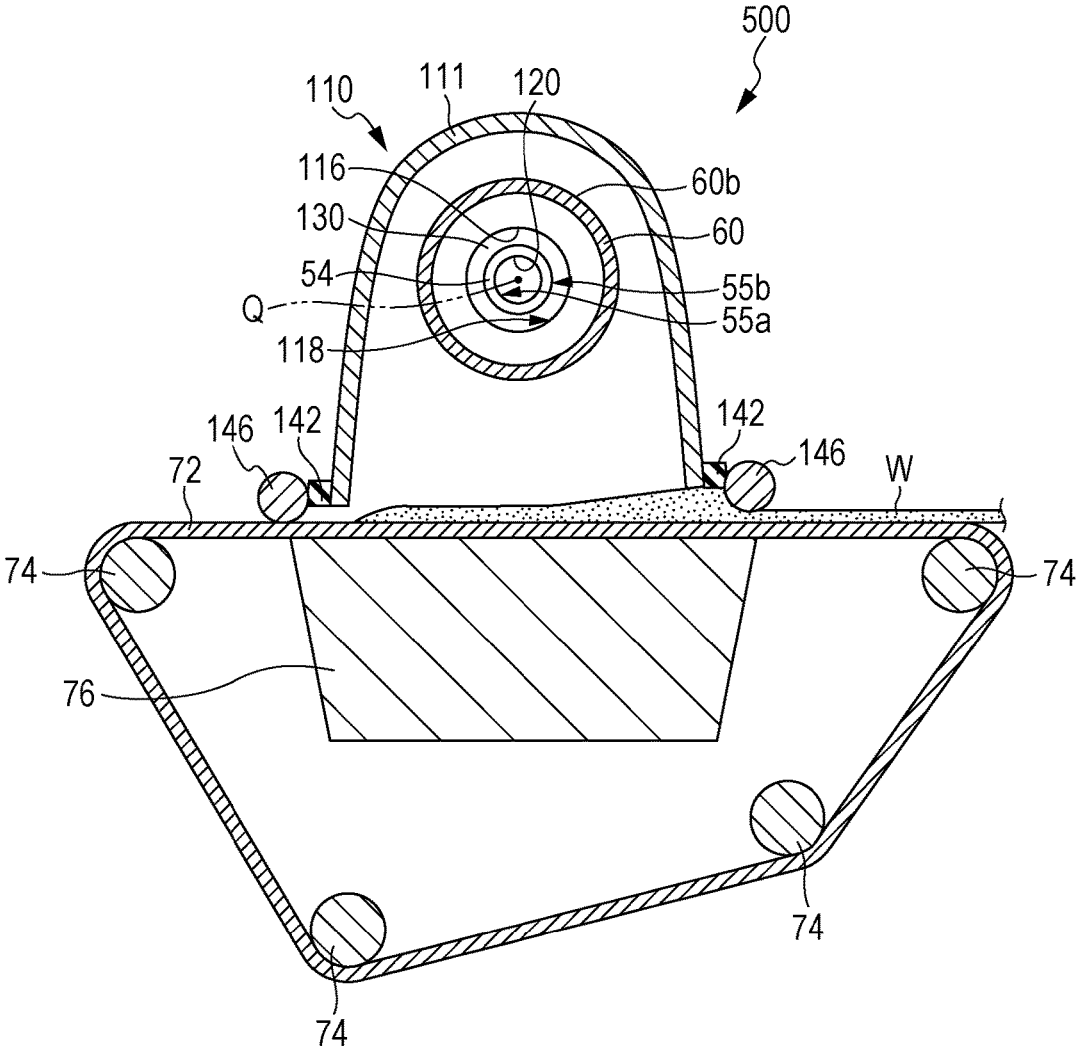
FIG. 11 is a sectional view schematically illustrating the sheet manufacturing apparatus according to the fourth modification example of the embodiment.

Next, a sheet manufacturing apparatus according to a fourth modification example of the embodiment will be described with reference to the drawings. FIGS. 10 and 11 are sectional views schematically illustrating a sheet manufacturing apparatus 500 according to the fourth modification example of the embodiment. Moreover, FIG. 10 illustrates the same cross section as FIG. 3 and FIG. 11 illustrates the same cross section as FIG. 4.

In the sheet manufacturing apparatus 100 described above, as illustrated in FIGS. 3 and 4, the housing unit 110 and the transport pipe 54 are integrally provided.

On the other hand, in the sheet manufacturing apparatus 500, as illustrated in FIGS. 10 and 11, a housing unit 110 and a transport pipe 54 are not integrally provided. Through holes 116 greater than a material supply port 120 in size are provided in side wall units 112*a* and 112*b* of the housing unit 110. Specifically, as illustrated in FIG. 11, the through hole 116 is greater than the material supply port 120 in size when viewed in a direction of a rotational axis Q. As illustrated in FIG. 11, the material supply port 120 overlaps the through hole 116 and is provided on an inside of an outer edge of the through hole 116 when viewed in the direction of the rotational axis Q. The through hole 116 is a through hole communicating an inside of the housing unit 110 with an outside thereof and extends in the direction of the rotational axis Q. A transport pipe 54 has an inner surface 55*a* forming (defining) the material supply port 120.

An air intake port 130 is an interval that is formed between a surface 118 of side wall units 112*a* and 112*b* of the housing unit 110 forming the through holes 116 and an outer surface 55*b* of a transport pipe 54 on a side opposite to the inner surface 55*a*. As illustrated in FIG. 11, the air intake port 130 is provided in a periphery of the material supply port 120 when viewed in the direction of the rotational axis Q. As illustrated in FIG. 11, the air intake port 130 is provided to surround the material supply port 120 when viewed in the direction of the rotational axis Q.

In the sheet manufacturing apparatus 500, the air intake port 130 is the interval that is formed between the surface 118 of the housing unit 110 forming the through holes 116 and the outer surface 55*b* of a transport pipe 54. Thus, in the sheet manufacturing apparatus 500, the air intake port 130 can be provided to surround the material supply port 120. Therefore, in the sheet manufacturing apparatus 500, for example, it is possible to further reliably suppress that airflow on an inside of a drum unit 60 is disturbed compared to a case where the air intake port 130 is provided not to surround the material supply port 120.

2.5. Fifth Modification Example

Figure 12:
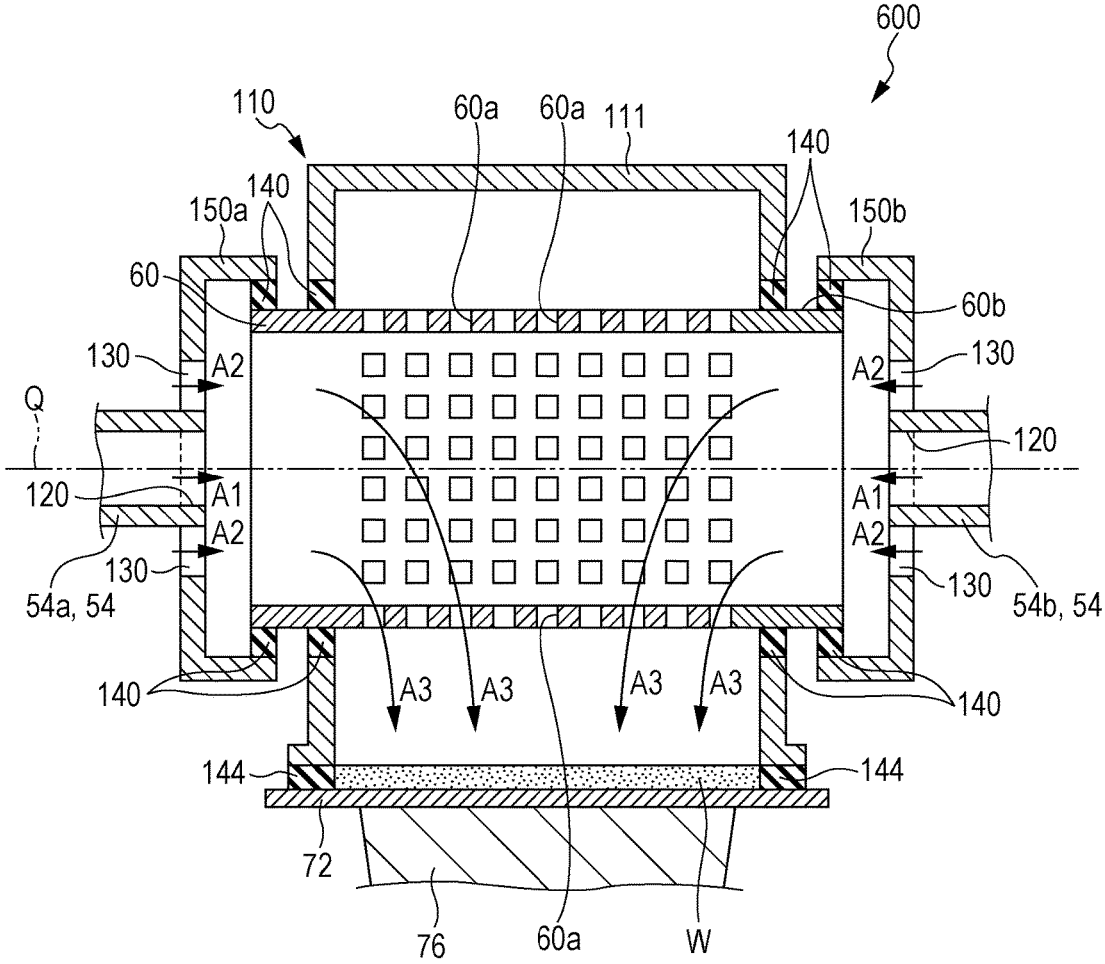
FIG. 12 is a sectional view schematically illustrating a sheet manufacturing apparatus according to a fifth modification example of the embodiment.

Next, a sheet manufacturing apparatus according to a fifth modification example of the embodiment will be described with reference to the drawing. FIG. 12 is a sectional view schematically illustrating a sheet manufacturing apparatus 600 according to the fifth modification example of the embodiment and illustrates the same cross section as FIG. 3.

In the sheet manufacturing apparatus 100 described above, as illustrated in FIG. 3, the housing unit 110 has the first side wall unit 112*a* and the second side wall unit 112*b* covering the drum unit 60 in the direction of the rotational axis Q.

On the other hand, in the sheet manufacturing apparatus 600, as illustrated in FIG. 12, a housing unit 110 does not have side wall units 112*a* and 112*b*. The sheet manufacturing apparatus 600 has a first lid unit 150*a* and a second lid unit 150*b* covering a drum unit 60 in a direction of a rotational axis Q. The lid units 150*a* and 150*b* are different members from the housing unit 110.

Material supply ports 120 are provided in the lid units 150*a* and 150*b*. The first lid unit 150*a* is connected to a first portion 54*a* of a transport pipe 54. The second lid unit 150*b* is connected to a second portion 54*b* of the transport pipe 54. The lid units 150*a* and 150*b* may be integrally provided with the transport pipe 54. The lid units 150*a* and 150*b* are connected to an outer peripheral surface 60*b* of the drum unit 60 through pile seals 140.

Air intake ports 130 are provided in the lid units 150*a* and 150*b*. In the illustrated example, one air intake port 130 is provided both above and below the material supply port 120 in each of the lid units 150*a* and 150*b*. Although not illustrated, the air intake port 130 may be provided to surround the material supply port 120 when viewed in the direction of the rotational axis Q.

In the sheet manufacturing apparatus 600, for example, it is possible to manufacture the sheet S having high uniformity of the grammage similar to the sheet manufacturing apparatus 100.

2.6. Sixth Modification Example

Figure 13:
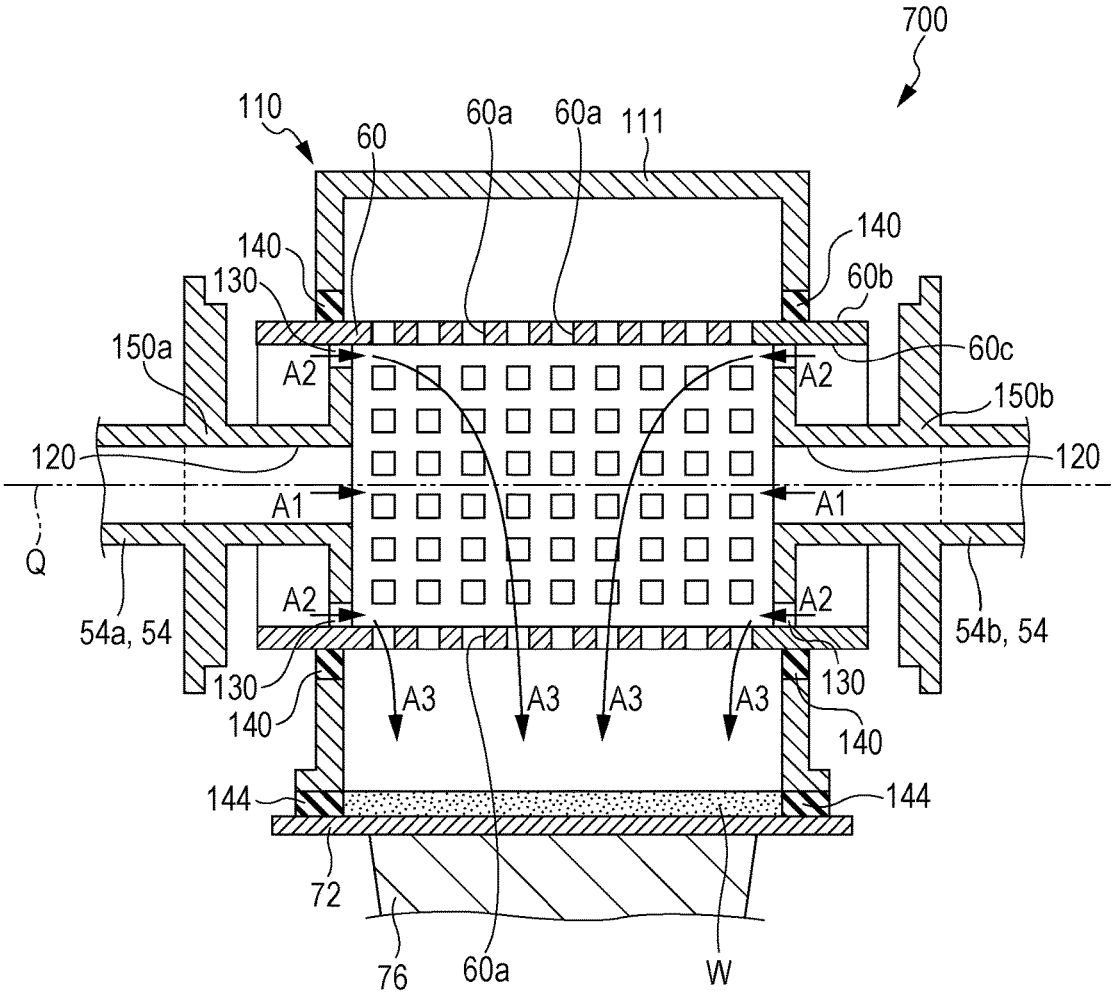
FIG. 13 is a sectional view schematically illustrating a sheet manufacturing apparatus according to a sixth modification example of the embodiment.

Next, a sheet manufacturing apparatus according to a sixth modification example of the embodiment will be described with reference to the drawing. FIG. 13 is a sectional view schematically illustrating a sheet manufacturing apparatus 700 according to the sixth modification example of the embodiment and illustrates the same cross section as FIG. 3.

In the sheet manufacturing apparatus 100 described above, as illustrated in FIG. 3, the housing unit 110 has the first side wall unit 112*a* and the second side wall unit 112*b* covering the drum unit 60 in the direction of the rotational axis Q.

On the other hand, in the sheet manufacturing apparatus 700, as illustrated in FIG. 13, similar to the sheet manufacturing apparatus 600 described above, a housing unit 110 does not have side wall units 112*a* and 112*b*, and has a first lid unit 150*a* and a second lid unit 150*b*.

In the sheet manufacturing apparatus 700, different from the sheet manufacturing apparatus 600 described above, the lid units 150*a* and 150*b* are not connected to an outer peripheral surface 60*b* of a drum unit 60 through pile seals 140.

Air intake ports 130 are intervals that are formed between the lid units 150*a* and 150*b*, and an inner peripheral surface 60*c* of the drum unit 60 on a side opposite to an outer peripheral surface 60*b*. In the illustrated example, one air intake port 130 is provided both above and below a material supply port 120 in each of the lid units 150*a* and 150*b*. Although not illustrated, the air intake ports 130 are provided to surround the material supply port 120 when viewed in a direction of a rotational axis Q.

In the sheet manufacturing apparatus 700, for example, it is possible to manufacture the sheet S having high uniformity of the grammage similar to the sheet manufacturing apparatus 100.

Moreover, the sheet S that is manufactured by the sheet manufacturing apparatus according to the invention mainly refers to those having a sheet shape. However, the sheet S is not limited to the sheet shape and may be a board shape or a web shape. The sheet in the present specification is divided into paper and non-woven fabric. Paper includes aspects formed in a thin sheet shape in which pulp or waste paper is a raw material and includes recording paper for writing or printing, wallpaper, wrapping paper, colored paper, drawing paper, Kent paper, and the like. Non-woven fabric has a thickness thicker than that of paper or has a strength lower than that of paper, and includes a general non-woven fabric, fiber board, tissue paper (cleaning tissue paper), kitchen paper, cleaner, filter, liquid (waste ink or oil) absorption material, sound-absorbing material, thermal insulation material, cushioning material, mat, and the like. Moreover, as the raw material, plant fibers such as cellulose, chemical fibers such as polyethylene terephthalate (PET) and polyester, and animal fibers such as wool and silk may be included.

The invention may omit some of a range having characteristics and advantages described in this application or may combine each of the embodiments and the modification examples. Moreover, a part of the configuration of the manufacturing unit 102 may be omitted, other configurations may be added to the manufacturing unit 102, or the manufacturing unit 102 may be replaced by a known configuration.

The invention includes a substantially same configuration (for example, same configuration in a function, a method, and a result or the same configuration in the object and the effect) as the configuration described in the embodiments. Furthermore, the invention includes a configuration that replaces non-essential parts of the configuration described in the embodiments. Furthermore, the invention includes a configuration which can perform the same operational effects or can achieve the same object as the configuration described in the embodiments. Furthermore, the invention includes a configuration obtained by adding a known technique to the configuration described in the embodiments.

The entire disclosure of Japanese Patent Application No.: 2014-238484, filed Nov. 26, 2014 and 2015-129594, filed Jun. 29, 2015 are expressly incorporated by reference herein.

What is claimed is:

1. A sheet manufacturing apparatus comprising:

a rotatable drum unit in which a plurality of openings are formed;

a web forming unit that forms a web by using a material containing fibers passing through the openings of the drum unit;

a housing unit that covers at least a portion of the drum unit in which the openings are formed;

a material supply port that is provided to supply the material containing fibers in a direction along a rotational axis of the drum unit to the inside of the drum unit by airflow; and an air intake port that is provided to supply air, that does not contain the material, in the direction along the rotational axis of the drum unit to the inside of the drum unit, wherein the air intake port is provided on a periphery of the material supply port, wherein the web forming unit includes a mesh belt on which the material containing fibers is deposited, and a suction unit that sucks the material containing fibers onto the mesh belt.

2. The sheet manufacturing apparatus according to claim 1, further comprising:

a transport pipe that has an inner surface forming the material supply port, wherein a through hole greater than the material supply port in size is provided in the housing unit, and wherein the air intake port is a gap formed between a surface of the housing unit forming the through hole and an outer surface of the transport pipe.

3. The sheet manufacturing apparatus according to claim 1, wherein the air intake port is provided further on the mesh belt side than the material supply port.

4. The sheet manufacturing apparatus according to claim 3, wherein the air intake port is provided in a position nearer to an end portion of the housing unit on a downstream side in a transport direction of the web than the material supply port.

5. A sheet manufacturing apparatus comprising:

a rotatable drum unit in which a plurality of openings are formed;

a web forming unit that forms a web by using a material containing fibers passing through the openings of the drum unit;

a housing unit that covers at least a portion of the drum unit in which the openings are formed;

a material supply port that is provided to supply the material containing fibers to the inside of the drum unit by airflow; and an air intake port that is provided to supply air that does not contain the material from the outside of the housing unit to the inside of the drum unit with the inside of the housing unit having a negative pressure, wherein the air intake port is provided on a periphery of the material supply port.

6. A sheet manufacturing apparatus comprising:

a rotatable drum unit in which a plurality of openings are formed;

a web forming unit that forms a web by using a material containing fibers passing through the openings of the drum unit;

a housing unit that covers at least a portion of the drum unit in which the openings are formed;

a material supply port that is provided to supply the material containing fibers in a direction along a rotational axis of the drum unit to the inside of the drum unit by airflow;

an air intake port that is provided to supply air, that does not contain the material, in the direction along the rotational axis of the drum unit to the inside of the drum unit, a transport pipe that has an inner surface forming the material supply port, wherein a through hole greater than the material supply port in size is provided in the housing unit, wherein the air intake port is a gap formed between a surface of the housing unit forming the through hole and an outer surface of the transport pipe, and wherein the web forming unit includes a mesh belt on which the material containing fibers is deposited, and a suction unit that sucks the material containing fibers onto the mesh belt.

7. A sheet manufacturing apparatus comprising:

a rotatable drum unit in which a plurality of openings are formed;

a web forming unit that forms a web by using a material containing fibers passing through the openings of the drum unit;

a housing unit that covers at least a portion of the drum unit in which the openings are formed;

a material supply port that is provided to supply the material containing fibers to the inside of the drum unit by airflow;

an air intake port that is provided to supply air that does not contain the material from the outside of the housing unit to the inside of the drum unit with the inside of the housing unit having a negative pressure; and a transport pipe that has an inner surface forming the material supply port, wherein a through hole greater than the material supply port in size is provided in the housing unit, wherein the air intake port is a gap formed between a surface of the housing unit forming the through hole and an outer surface of the transport pipe.

8. The sheet manufacturing apparatus according to claim 7, wherein the air intake port is provided on a periphery of the material supply port.

9. A sheet manufacturing apparatus comprising:

a rotatable drum unit in which a plurality of openings are formed;

a web forming unit that forms a web by using a material containing fibers passing through the openings of the drum unit;

a housing unit that covers at least a portion of the drum unit in which the openings are formed;

a material supply port that is provided to supply the material containing fibers in a direction along a rotational axis of the drum unit to the inside of the drum unit by airflow; and an air intake port that is provided to supply air, that does not contain the material, in the direction along the rotational axis of the drum unit to the inside of the drum unit, wherein the air intake port is provided further on the mesh belt side than the material supply port, wherein the web forming unit includes a mesh belt on which the material containing fibers is deposited, and a suction unit that sucks the material containing fibers onto the mesh belt.

10. A sheet manufacturing apparatus comprising:

a rotatable drum unit in which a plurality of openings are formed;

a web forming unit that forms a web by using a material containing fibers passing through the openings of the drum unit;

a housing unit that covers at least a portion of the drum unit in which the openings are formed;

a material supply port that is provided to supply the material containing fibers to the inside of the drum unit by airflow; and an air intake port that is provided to supply air that does not contain the material from the outside of the housing unit to the inside of the drum unit with the inside of the housing unit having a negative pressure, wherein the air intake port is provided further on the mesh belt side than the material supply port.

11. The sheet manufacturing apparatus according to claim 10, wherein the air intake port is provided on a periphery of the material supply port.

* * * * *